US006949871B2

(12) United States Patent
Tu

(10) Patent No.: US 6,949,871 B2
(45) Date of Patent: Sep. 27, 2005

(54) METAL HALIDE LAMP WITH IMPROVED FIELD WIRE

(75) Inventor: Junming Tu, Bath, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 31 days.

(21) Appl. No.: 10/179,314

(22) Filed: Jun. 24, 2002

(65) Prior Publication Data

US 2003/0234605 A1 Dec. 25, 2003

(51) Int. Cl.[7] ..... H01J 61/30
(52) U.S. Cl. ..... 313/25; 313/623
(58) Field of Search ..... 313/25, 623–625, 313/636–639, 642, 634, 283–285, 292, 49–51, 318.01, 318.02

(56) References Cited

U.S. PATENT DOCUMENTS 2,152,997 A 4/1939 Johnson
3,995,928 A 12/1976 Shaffner et al.
4,422,004 A * 12/1983 Knecht ..... 313/25
4,918,352 A 4/1990 Hess et al.
5,014,419 A * 5/1991 Cray et al. ..... 29/830
5,023,506 A * 6/1991 Canale et al. ..... 313/25
5,043,623 A * 8/1991 Scholz et al. ..... 313/25
5,112,232 A * 5/1992 Cray et al. ..... 439/75
5,184,400 A * 2/1993 Cray et al. ..... 29/879
5,272,407 A * 12/1993 Tillman et al. ..... 313/25
5,339,001 A 8/1994 King et al.
5,408,157 A * 4/1995 Alderman et al. ..... 313/25
5,466,987 A * 11/1995 Williamson ..... 313/25
5,670,840 A * 9/1997 Lanese et al. ..... 313/25
6,054,810 A * 4/2000 Yamamoto et al. ..... 313/607
6,157,131 A * 12/2000 Nelson et al. ..... 313/634

* cited by examiner

*Primary Examiner*—Joseph Williams
*Assistant Examiner*—Dalei Dong

(57) ABSTRACT

An improved discharge lamp is provided which includes a discharge vessel (arc tube) enclosing a discharge space, the discharge vessel (arc tube) including within the discharge space a metal halide ionizable material; first and second discharge electrode feedthroughs, and first and second current conductors connected to the first and second discharge electrode feedthroughs, respectively. The improvement is through the use of a field wire of a material that includes Ni or Ni alloy, and wherein the field wire material exhibits an electrical resistivity at 25° C.<10 ohms/mm$^2$; a photoelectric emission work function>4.0 eV; a thermionic emission work function>4.0 eV; and a melting point>1200° C.

3 Claims, 1 Drawing Sheet

METAL HALIDE LAMP WITH IMPROVED FIELD WIRE

FIELD OF THE INVENTION

This invention relates to a metal halide lamp with improved field wire.

BACKGROUND OF THE INVENTION

Electric lamps which have a light source capsule with a generally planar seal(s) include, among others, high intensity discharge (HID) metal halide and mercury vapor lamps. The light source capsule in these lamps is a discharge vessel or arc tube of fused silica (quartz glass) which typically is sealed at both ends by a press seal which includes two major, substantially parallel faces and two minor, side faces extending between the major faces. Conductive lead-throughs extend through the press seal in a gas-tight manner to a pair of discharge electrodes arranged within the arc tube.

These lamps typically have an outer envelope which is sealed at one end by a lamp stem. A frame comprising a field wire and metallic support rods extends from the lamp stem and supports the arc tube within the outer envelope. Metallic support straps secured about the press seals are welded to a support rod on one or both sides of the press seal to secure the arc tube to the frame.

Photoelectron emission can be very detrimental to certain electric lamps. In quartz metal halide discharge lamps the arc tube contains during lamp operation an ionized plasma of mercury, sodium halide, and other metals such as scandium iodide and lithium iodide. Sodium and lithium ions have a relatively high rate of diffusion through heated quartz. Photoelectrons which collect on the outer surface of the arc tube create a negative potential that attracts the positive sodium or lithium ions and accelerates their diffusion through the wall of the arc tube. The production of photoelectrons substantially accelerates the depletion of sodium within the arc tube and thus shortens the useful life of the lamp.

In the past thirty years, many efforts have been made to reduce Na loss in quartz metal halide lamps. Nitrogen gas is normally filled in the lamp envelope to retard photoelectrons reaching the arc tube wall. Maximizing the distance between the arc tube and field wire in a lamp can reduce photoelectrons on the arc tube surface. The other method includes the use of low Na permeability quartz glass. It has been found that the use of low photoelectric emission and low thermionic emission field wire material is important to reduce Na loss. Low electrical resistivity is necessary to have low power consumption for the field wire. Sufficient high melting temperature for a field wire material is required to maintain its function over long lamp life.

U.S. Pat. No. 2,152,997 relates to mercury electric discharge lamps which have a helix of tungsten, molybdenum, nickel, and other metal welded to the inlead and extending along the envelope. The major difference in this type of lamp and metal halide lamps is that metal halide (MH) lamp contains sodium iodide and other metal iodides such as lithium iodides or bromides in the arc tube that could diffuse through the quartz arc tube. Due to the presence of metal iodides or bromides in the arc tube, a field wire should have a low photoelectric emission and low thermionic emission to minimize sodium or lithium diffusion. The field wire should be mounted in a position as far as possible to the arc tube to reduce Na or Li diffusion. These are not requirements for mercury discharge lamps because metal iodides or bromides are not present in the arc tube.

A material to be used as a field wire in metal halide discharge lamp should meet the following requirements:

electrical resistivity at 25° C.<10 ohms/mm$^2$ photoelectric emission work function>4.0 eV thermionic emission work function>4.0 eV melting point>1200° C.

Pure molybdenum wire has been widely used in the metal halide lamps for many years. Molybdenum has a high melting temperature and good electrical conductivity but it has certain drawbacks such as relatively high photoelectric emission, high cost, and less resistance to oxidation. High photoelectric emission can cause Na and Li diffusion through the quartz arc tube wall and result in poor lumen maintenance, color shift, arc tube wall blackening, and a constricted arc. In the worst case, the quartz arc tube can be devitrified and lead to a non-passive failure due to constricted arc and high wall temperature.

There is a need in the art for a field wire made of a less expensive material that also possesses the required characteristics. There is also a need in the art for a field wire that has a lower photoelectric emission and lower thermionic emission than molybdenum to reduce Na loss.

SUMMARY OF THE INVENTION

An object of the invention is to provide an electric lamp with a field wire made of a less expensive material than molybdenum and in addition meets the above characteristics.

Another object of the invention is to provide a metal halide electric discharge lamp that includes a field wire made of a less expensive material than molybdenum and in addition meets the above characteristics.

Another object of the invention is to provide a metal halide electric discharge lamp that includes a field wire that has a lower photoelectric emission and lower thermionic emission than molybdenum.

These and other objects of the invention are achieved with the provision, according to the invention, of a discharge lamp comprising an arc tube enclosing a discharge space, said arc tube including within said discharge space an ionizable material comprising a metal halide, a first and second discharge electrode feedthrough means, and a first and second current conductor connected to said first and second discharge electrode feedthrough means, respectively;

said lamp having a field wire that comprises a Ni or Ni alloy that exhibits the following characteristics: an electrical resistivity at 25° C.<10 ohms/mm$^2$; a photoelectric emission work function>4.0 eV; a thermionic emission work function>4.0 eV; and a melting point>1200° C.

In a preferred embodiment of the invention, the field wire is selected from Ni or Ni alloys that meet the above requirements such as Ni200; Ni201; Ni205; Ni220, etc. Such alloys are available commercially from Central Wire, of Ontario, Canada. It has been found that not all Ni alloys meet the requirements and the following Ni alloy types have been found not to meet the requirements and thus cannot be used as a field wire in metal halide lamps of the invention although they perform satisfactorily in mercury discharge lamps: Ni 211; Ni 212; Ni 213; and Ni 305.

BRIEF DESCRIPTION OF THE DRAWINGS

The FIGURE illustrates a metal halide lamp according to the invention.

The invention will be better understood with reference to the details of specific embodiments that follow:

DETAILED DESCRIPTION OF THE PREFERRED EMBODIMENTS

Figure 1:
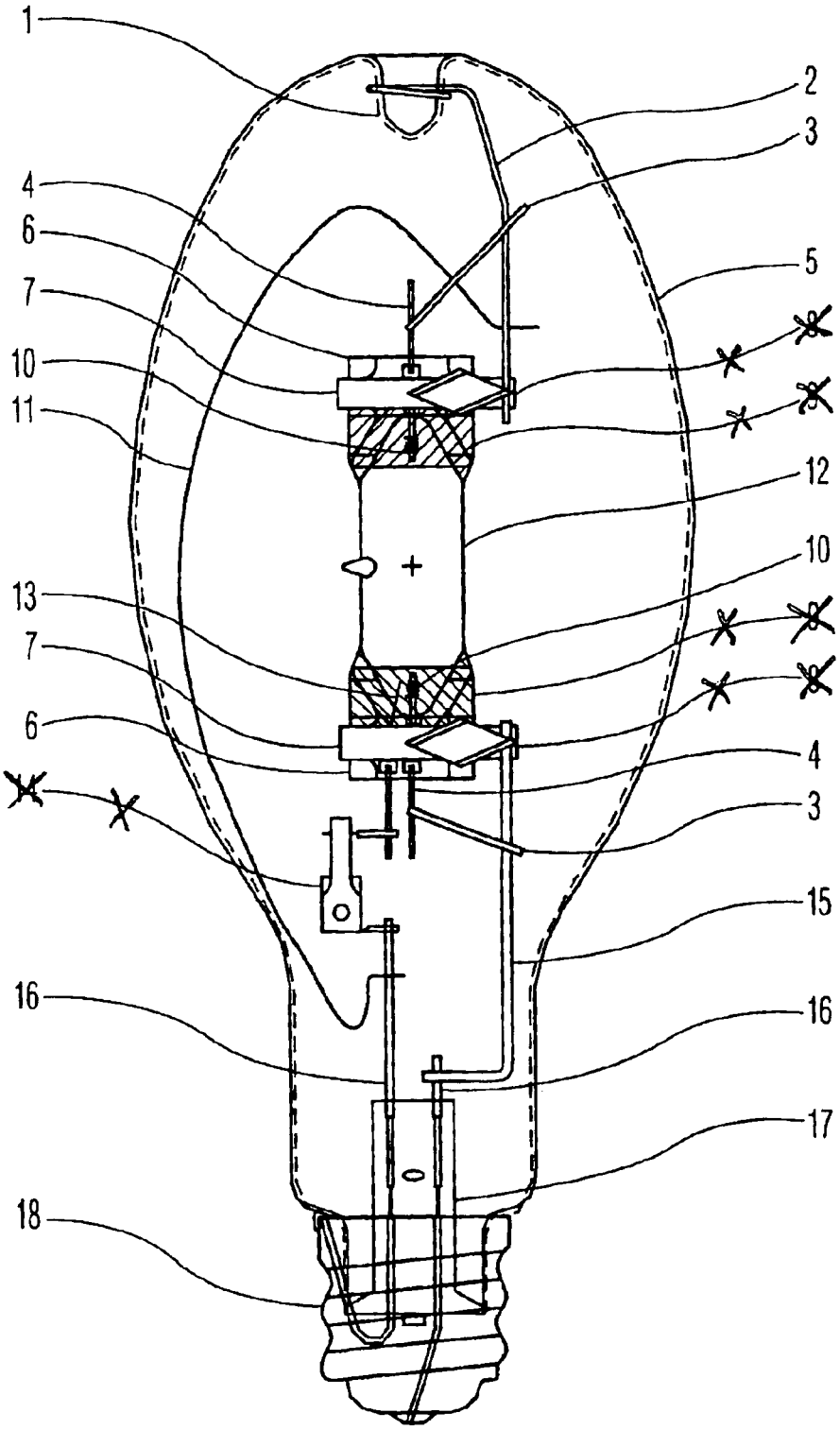

The FIGURE illustrates a metal halide (HID) lamp having an outer lamp envelope 5 with a dome portion which includes an inwardly extending dimple 1. A conventional lamp stem 17 seals the base end of the outer envelope 5 in a gas-tight manner. A conventional screw base 18 is arranged on the envelope.

Arranged within the envelope 5 is a conventional arc tube 12 of fused silica (quartz) glass which encloses a discharge space and in which a pair of discharge electrodes 10 and 13 are arranged at opposite ends of the discharge space. The ends of the arc tube are sealed by generally planar press seals 6, through which electrically conductive lead-throughs 4 extend to the discharge electrodes in a gas-tight manner. The arc tube includes a conventional discharge sustaining filling of mercury, a rare gas, and sodium halide and one or more metal alkali-halides, such as a scandium halide.

The arc tube is supported within the outer envelope by a frame consisting of first (base side) and second (dome side) frame sections. The first frame section on the base side of the lamp extends from the lamp stem 17 and includes a lead through 16, a metallic support rod 15 extending adjacent the press seal 6 facing the stem, and connected to a support strap 7 attached to the base side of arc tube 12. The second frame section (dome side) includes a support rod 2 contacting the dimple 1 at the dome end of the lamp envelope and extending axially adjacent a minor face of the other press seal 6, and connected to a support strap 7 attached to the dome side of the arc tube 12. The electrode 10 is connected to a contact on the base 18—by a field wire 11 composed of Ni or a suitable Ni alloy, via lead through 4, conductive strap 3 and conductive support rod 2 on the dome side of the lamp, and by lead-through 16 on the dome side of the lamp.

According to the invention, the Ni has an electrical resistivity at 25° C.<10 ohms/mm$^2$; a photoelectric emission work function>4.0 eV ; a thermionic emission work function>4.0 eV; and a melting point>1200° C. Ni is four to five times less expensive than molybdenum and ten times less expensive than tungsten. The thermionic work function for Ni is higher than Mo (4.61 eV vs. 4.15 eV). Ni has a higher photoelectric emission work function of 4.9 eV compared to 4.2 eV for Mo. Thus, the use of NI as a field wire produces less photoelectric and thermionic emissions than Mo. The mechanical strength for Ni200 and Ni201 is close to Mo. Ni200 and Ni201 have a higher resistance to oxidation.

It has been found that to achieve the same electrical conductivity, it is necessary to increase the diameter of the Ni field. For example, 0.76 mm diameter of Ni has the same electrical conductivity as 0.61 mm diameter of Mo. However, a test on MH250/U lamps in vacuum fill outer bulb showed that all lamps with Ni200 field wire survived at 2,000 hours whereas 80% of such lamps with Mo field wire failed due to a rise in voltage (higher photoelectric emission causes Na loss resulting in a voltage rise). It has also been found that ½ hard Ni materials are advantageously used in this invention to assure that the field wire will be of sufficient resilience to assume the desired shape and spacing from the arc tube after assembly into the arc tube.

It will be understood that the foregoing description is given for descriptive purposes only and the invention may be embodied in other specific forms without departing from the spirit and scope or essential characteristics thereof, the present disclosed examples being only preferred embodiments thereof.

What is claimed is:

1. A discharge lamp comprising: a discharge vessel enclosing a discharge space, said discharge vessel including within said discharge space an ionizable material comprising a metal halide; a first and second discharge electrode feedthrough means, and a first and second current conductor connected to said first and second discharge electrode feedthrough means, respectively; at least one of the first and second current conductor comprising a field wire consisting essentially of an alloy selected from the group consisting of Ni200, Ni201, Ni205 and Ni220 alloy.

2. A discharge lamp comprising: an arc tube enclosing a discharge space, said arc tube including within said discharge space an ionizable material comprising a metal halide; a first and second discharge electrode feedthrough means, and a first and second current conductor connected to said first and second discharge electrode feedthrough means, respectively, at least one of the first and second current conductor comprising a field wire consisting essentially of a Ni alloy, said Ni alloy being a ½ hard Ni alloy selected from the group consisting of Ni200, Ni201, Ni205 and Ni220.

3. A high pressure gas discharge lamp comprising: an outer lamp envelope including a lamp stem and an opposing dome end; a light source arranged within said outer lamp envelope, said light source including an arc tube having a press seal at each end thereof, an alkali-halide containing discharge sustaining filling, a pair of discharge electrodes within said arc tube between which an arc discharge is maintained during lamp operation, and conductive lead-throughs extending from each electrode through a respective press seal to the exterior of said arc tube, and a frame supporting the arc tube within the outer envelope consisting of first and second frame sections, the first frame section extending from the lamp stem and including a metallic support rod near the stem, the second frame section including a support rod near the dimple at the dome end of the lamp envelope, the electrodes being connected to respective contacts on a base by a field wire consisting of a Ni alloy selected from the group consisting of Ni200, Ni201, Ni205 and or Ni220.

* * * * *